US010392750B2

(12) United States Patent
Erkelenz et al.

(10) Patent No.: US 10,392,750 B2
(45) Date of Patent: Aug. 27, 2019

(54) METHOD AND DEVICE FOR MONITORING A WEAR STRUCTURE, IN PARTICULAR A SEALING STRUCTURE

(71) Applicant: VOITH PATENT GMBH, Heidenheim (DE)

(72) Inventors: Mark Erkelenz, Neu-Ulm (DE); Jochen Honold, Schlingen (DE); Christian Gommeringer, Ravensburg (DE); Samee Faraji, Baindt (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 15/568,549

(22) PCT Filed: Apr. 21, 2016

(86) PCT No.: PCT/EP2016/058876
§ 371 (c)(1),
(2) Date: Oct. 23, 2017

(87) PCT Pub. No.: WO2016/170042
PCT Pub. Date: Oct. 27, 2016

(65) Prior Publication Data

US 2018/0119355 A1 May 3, 2018

(30) Foreign Application Priority Data

Apr. 23, 2015 (DE) ..... 10 2015 207 383
Jun. 16, 2015 (DE) ..... 10 2015 210 990

(51) Int. Cl.

| | |
|---|---|
| ***D21D 5/16*** | (2006.01) |
| ***D21G 9/00*** | (2006.01) |
| ***D21D 5/02*** | (2006.01) |
| ***D21F 1/52*** | (2006.01) |
| ***D21F 3/10*** | (2006.01) |

(52) U.S. Cl.
CPC ..... *D21G 9/0027* (2013.01); *D21D 5/023* (2013.01); *D21D 5/16* (2013.01); *D21F 1/52* (2013.01); *D21F 3/10* (2013.01)

(58) Field of Classification Search
USPC ..... 162/374
See application file for complete search history.

(56) References Cited

U.S. PATENT DOCUMENTS

| | | | |
|---|---|---|---|
| 9,447,542 | B2 | 9/2016 | Erkelenz et al. |
| 2015/0168255 | A1 | 6/2015 | Hamilton et al. |

FOREIGN PATENT DOCUMENTS

| | | | |
|---|---|---|---|
| CN | 104246068 | A | 12/2014 |
| CN | 104335022 | A | 2/2015 |
| CN | 104335023 | A | 2/2015 |
| CN | 104335024 | A1 | 2/2015 |
| DE | 102007027688 | A1 | 12/2008 |
| DE | 102012208811 | B3 | 7/2013 |
| DE | 102012207692 | A1 | 11/2013 |
| DE | 102012208795 | A1 | 11/2013 |
| WO | 03056215 | A1 | 7/2003 |
| WO | 2013160056 | A1 | 10/2013 |

*Primary Examiner* — Mark Halpern
(74) *Attorney, Agent, or Firm* — Laurence A. Greenberg; Werner H. Stemer; Ralph E. Locher

(57) ABSTRACT

A method for monitoring a wear structure including at least one wear element in a machine for generating or processing a fibrous material web, includes providing a time at which the wear element became operational, providing a time at which a defined first wear level of the wear element was reached, providing at least one further characteristic variable, and predicting a remaining operating time of the wear element from the knowledge of the times, in particular from a time difference between the times, as well as from the at least one further characteristic variable, by using a computer system. A device for carrying out the method is also provided.

7 Claims, 3 Drawing Sheets

METHOD AND DEVICE FOR MONITORING A WEAR STRUCTURE, IN PARTICULAR A SEALING STRUCTURE

This application is a 371 of PCT/EP2016/058876 filed 21 Apr. 2016

BACKGROUND OF THE INVENTION

Field of the Invention

The invention relates to a method for monitoring a wear structure, in particular a sealing structure in a machine for producing or processing a fibrous web, in which the wear structure includes at least one wear element which, in particular, is subjected to wear as a result of frictional contact, and the method includes the steps of providing a time z0 at which the wear element became operational, and providing a time z1 at which a defined first level of wear of the wear element was reached. The invention also relates to a device for monitoring a sealing structure for sealing at least one negative or positive pressure zone adjoining a surface moving in a direction of movement in a machine for producing or processing a fibrous web, including at least one sealing element having at least one wear sensor, preferably a plurality of wear sensors, a computer system and a device for signal transmission from the at least one wear sensor to the computer system.

In machines for producing paper or board, a multiplicity of evacuated rolls are used. In these suction rolls, it is usual for one or more suction zones to be sealed off with respect to the inner wall of the roll shell, in order to prevent too high a drop in the vacuum and therefore to reduce the suction action. In practice, this sealing is normally carried out by means of so-called sealing strips, which are pressed with a certain pressure against the inner wall of the roll shell. These sealing strips are in frictional contact with the roll shell and, as a result, are subjected to comparatively high wear as a result of abrasion.

To reduce the wear, it is known, for example from DE 10 2012 207 692, to introduce a lubricant between roll shell and sealing strip. However, since the wear cannot be eliminated completely, the sealing strips have to be replaced after a certain time. Because of the installation situation of the sealing strips in the suction roll, the current state of wear of the sealing strip can, however, generally not be determined or determined only very roughly without opening the suction roll and therefore interrupting the production process. Since, in the event of too late a replacement of the sealing strips, it is possible for damage to the suction roll to occur, the sealing strips are often replaced considerably before the end of their operating time, although this is associated with increased costs. Therefore, from an economical point of view, it is desirable to obtain more accurate information about the state of wear of the sealing strip during continuous operation. From the prior art, for example DE 10 2012 208 811, it is known to integrate sensors into the sealing strip which, during the operation of the suction roll, supply information about the level of wear. In addition, in WO 03/056215, it is proposed to determine an estimate for the remaining operating time of the sealing strip from the knowledge of the installation time of the strip and of the current wear.

However, these systems have the deficiency that the wear of the sealing strips is usually not carried out uniformly over time, and the estimate of the remaining operating time is only insignificantly more accurate than the practical knowledge of the papermaker.

It is an object of the present invention to propose a method which permits a considerably more accurate prediction of the remaining operating time of a wear element, in particular of a sealing strip, than the method known from the prior art.

SUMMARY OF THE INVENTION

The object is completely achieved by a method for monitoring a wear structure which includes providing at least one further characteristic variable K1, predicting a remaining operating time of the wear element from the knowledge of the times z0 and z1, in particular from the time difference between z0 and z1, and also the at least one further characteristic variable K1, by using a computer system. The object is also achieved by a device for monitoring a sealing structure by carrying out a prediction of the remaining operating time of the sealing element with the aid of the computer system by using the method.

The method according to the invention describes a method for monitoring a wear structure in a machine for producing or processing a fibrous web. The wear structure comprises at least one wear element which, in particular, is subjected to wear as a result of frictional contact. Furthermore, the sealing structure can also comprise still further components such as, for example, holders for the at least one wear element or means for pressing the wear element onto a moving surface or else means for moving the wear element.

A particularly preferred embodiment of this method according to the invention is a method for monitoring a sealing structure for sealing at least one negative or positive pressure zone adjoining a surface moving in a direction of movement in a machine for producing or processing a fibrous web. The sealing structure comprises at least one sealing element which is in frictional contact with the moving surface and as a result is subjected to wear. The sealing structure can additionally also comprise still further components such as, for example, holders for the at least one sealing element or means for pressing the sealing element onto the moving surface.

In a particularly preferred embodiment of the method, the moving surface is the rotating shell of a suction roll and the sealing element or the sealing elements is/are sealing strips which are pressed against the roll shell for the purpose of sealing. However, other sealing structures are also conceivable, such as the sealing of a suction box on a moving fabric, for example.

In order to carry out the method according to the invention, a time z0 at which the wear element or the sealing element was installed or became operational is provided. The provision of this or another time can either be carried out automatically or else by means of a manual entry. Furthermore, a time z1 at which a defined first level of wear of the wear element or the sealing element was reached is provided. The difference between these two times describes the time which has elapsed until the defined level of wear was reached. By means of an extrapolation, for example a linear extrapolation, a first estimate for the remaining operating time of the wear element or the sealing element can already be obtained. For instance, it could be deduced: 50% wear in n days, this results in 100% wear in 2 times n days. However, it transpires that the wear of the wear element or of the sealing element does not necessarily proceed uniformly over time. For example, a relatively long stoppage of the machine or the intensified production of grades in which the machine can be operated only at low speed, etc., can lead to the remaining operating time of the sealing element being considerably over-estimated or under-estimated. The invention therefore provides for at least one further characteristic variable K1 to be provided which, for example, contains information about one or more aspects which contribute to non-uniform wear of the wear element or of the sealing element. This can be data relating to the machine speed or stoppage times in the operating time period of the wear element or the sealing element. However, other data can also be relevant and provided as a further characteristic variable K1. By way of example but not conclusively, the following may be listed here: information about the lubricant monitoring, change in the internal roughness of the roll shell, number of roll revolutions, contact pressure of the sealing strip, etc.

The prediction of a remaining operating time of the wear element or of the sealing element is carried out, according to the invention, by using the times z0 and z1 or the time difference between z0 and z1 and also the at least one further characteristic variable K1, by means of a computer system. It is thus possible to calculate a considerably improved prediction of the remaining operating time of the wear element or of the sealing element than is possible only on the basis of the time information. By way of example, only the quite simple approach may be described here in which, instead of the operating time z1-z0, an effective operating time of the sealing element is used, that is to say the time z1-z0 minus the stoppage times of the machine in this time period. This effective operating time can then be extrapolated linearly, for example as described above. Alternatively, it is also possible to describe the effective operating time via the number of roll revolutions in the time period z1-z0. By extrapolation, it is then possible to make an estimate as to for how many roll revolutions the sealing element can still be used. This can be converted on the basis of an average speed or else the current speed into a remaining operating time. However, a large number of other methods for calculating the prediction of a remaining operating time are also conceivable according to the invention.

After a prediction of the remaining operating time of the wear element or of the sealing element has been carried out at the provision of the time z1, this prediction can be monitored continuously and, for example, corrected on the basis of changes in the further characteristic variable K1 and, of course, with incorporation of the current date or the current time.

Further advantageous embodiments of the invention are described in the further subclaims.

Thus, in preferred embodiments of the invention, it may be advantageous that, in addition to the characteristic variable K1, additional, further characteristic variables K2, K3, K4 . . . are also provided and these characteristic variables are also incorporated into the prediction of the remaining operating time of the wear element or of the sealing element. With the aid of these additional further characteristic variables, the quality of the prediction can be improved further in many cases. Depending on the application, up to four characteristic variables or up to eight such characteristic variables or even more than eight such further characteristic variables can also be incorporated into the prediction of the remaining operating time.

In advantageous embodiments of the invention, the characteristic variable K1 and/or one or more of the additional further characteristic variables K2, K3, K4 . . . can describe one or more aspects of the operating mode of the machine. In particular, the operating mode of the machine since the time at which the sealing element became operational can be described by these characteristic variables. However, provision can also be made for the characteristic variables also to include information from the time before the installation of the wear element or of the sealing element. In particularly advantageous embodiments, information about future operating modes of the machine can also be provided as a further characteristic variable. Here, this can be, for example, data from production planning such as, for example, a usual grade running order, or information about planned stoppages, etc.

Provision can be made, for example, for the further characteristic variable K1 and/or one or more of the additional further characteristic variables K2, K3, K4 . . . to describe the machine speed, the operating times of the machine, the stoppage times of the machine, the type and/or quantity of the products produced, the contact pressure of the sealing element onto the moving surface. However, other or further variables are also possible.

Here, it should be mentioned that this data which is used for the characteristic variables K1, K2, K3, K4 . . . originates from various sources and that the characteristic variables can be described by means of various measured values. Thus, the machine speed can be present directly as a production speed of the machine in m/min. However, it can also be described, for example, in the form of the rotational speed of a suction roll, the rotational speed of one or more drives present or the like. In addition, the number of roll revolutions starting from a specific time can be used as a description of the machine speed. These data items all describe the production speed of the machine and can be converted into one another very simply, if appropriate given the knowledge of geometric variables such as a roll circumference or the like. It is clear to those skilled in the art that these different descriptions of the same property are identical for their use as characteristic variable K1, K2, K3, K4 . . . . The same is true for an alternative description of the data which describes the stoppage times of the machine, the type and/or quantity of the products produced, the contact pressure of the sealing element onto the moving surface, etc.

By means of the combinations of a plurality of characteristic variables, a multiplicity of advantageous data items can be used to determine the remaining operating time of the sealing element. Some will be listed by way of example here.

Thus, in one advantageous embodiment, provision can be made, for example, for the characteristic variable K1 to be a variable which describes the machine speed, and for the characteristic variable K2 to describe the type and/or quantity of the products produced or the contact pressure of the sealing element onto the moving surface.

In a further advantageous embodiment, provision can be made, for example, for the characteristic variable K1 to indicate the number of roll revolutions since a specific time (e.g. the installation of the sealing element)—a type of description of the machine speed—and for the characteristic variable K2 to describe the internal roughness of the roll shell.

A characteristic variable K3 which contains information about the lubricant supply of the sealing element (e.g. the quantity of lubricating water) can in both cases be used additionally or else as a replacement for one of the characteristic variables K1 or K2.

The combinations of characteristic variables indicated here do not form any final enumeration of the possible combinations according to the invention but are intended merely to document by way of example the possibilities of the configuration of the method according to the invention.

The provision of the data can be carried out in an extremely wide range of ways, according to the invention. For example, provision can thus be made for the further characteristic variables to be retrieved continuously and stored in a database. This database can be created, for example, on the computer of the computer system on which the calculation is carried out or else on another computer. Provision can also be made for this other computer to be operated not by the operator of the paper machine but by another operator, and for the data to be transmitted to this database.

In a further advantageous embodiment of the invention, after the time z1, at least one further time z2, preferably a plurality of further times z3, z4 . . . can be provided, at which a defined second, third, fourth . . . level of wear has been reached, wherein in each case when a new time is provided the remaining operating time can be re-determined by incorporating all the times already provided and the further characteristic variable or the further characteristic variables. The provision of further times at which a defined level of wear has been reached is therefore advantageous since the accuracy of the prediction of the remaining operating time is therefore improved further. Particularly toward the end of the service life of the sealing element, this is advantageous in order to be able to choose the most optimal time possible for the replacement of the sealing element.

It is particularly advantageous if the provision of at least one of the times z1, z2, z3, z4 . . . , preferably all the times which are incorporated into the prediction of the remaining operating time, is carried out by means of a signal which is transmitted directly or indirectly from a sensor in the wear element or the sealing element to the computer system. Here, for economic reasons, it is usual for a maximum of two or three sensors to be used in a sealing element. However, more than three sensors in a sealing element are also possible.

Furthermore, provision can advantageously be made for at least one of the further characteristic variables K1, K2, K3, K4 . . . , preferably a plurality of the further characteristic variables K1, K2, K3, K4 . . . , to be provided by a control system, which is also used for the monitoring, open-loop control and/or closed-loop control of the machine.

For the method, it may be advantageous if one of the levels of wear is defined between 80% and 50% remaining wear. The exact knowledge that a comparatively early level of wear has been reached makes it possible to determine a first prediction of the remaining operating time of the wear element or of the sealing element very early.

Likewise, it may be advantageous for the method if one of the levels of wear is defined between 20% and 10% remaining wear, preferably between 20% and 15% remaining wear. The exact knowledge that a comparatively late level of wear has been reached permits a more accurate prediction of the remaining operating time of the wear element or of the sealing element.

Furthermore, it may be advantageous that the remaining operating time is displayed on a display device.

In a further variant according to the invention, the method can additionally comprise the steps:

d) defining at least one threshold value for the remaining operating time e) checking whether the remaining operating time falls below the at least one defined threshold value f) generating an advice signal if the remaining operating time falls below the at least one defined threshold value.

Such a threshold value can, for example, be chosen such that a routine stoppage of the machine, during which the sealing element can be changed, always falls in the remaining operating time. The threshold value can also be chosen such that sufficient time still remains for the operator to re-order a new wear element or sealing element. There is also the possibility of defining a plurality of threshold values, at which signals for different actions are generated (e.g. a signal for initiating an order and a later signal for the planning of the replacement of the sealing element).

The advice signal generated or one of the advice signals generated can be displayed, for example, on an optical or acoustic display device and/or forwarded to a further computer system. Here, according to the invention, provision can be made, for example, for such a signal to be forwarded to an electronic procurement system.

In advantageous embodiments of the method, the prediction of a remaining operating time of the wear element or of the sealing element can be carried out in the form of a single value or else in the form of an interval. A combination of the two is also possible. Thus, for example, provision can be made that, in addition to the estimated remaining operating time, a lower limit and an upper limit for the remaining operating time are also indicated. These can be determined, for example, under the assumption that one or more of the further characteristic variables K1, K2, K3, K4 . . . will change in the future by a certain percentage. By way of example, the possibility should be mentioned here that the lower limit indicates how long the remaining operating time is if in the future the average machine speed is increased by 5% or 10% or the average stoppage time of the machine is reduced by 5% or 10%. In a similar way, the remaining operating time would be specified as an upper limit for the case in which in the future the average machine speed is reduced by 5% or 10% or the average stoppage time of the machine is increased by 5% or 10%.

In this way, the operator is given advice about the reliability of the estimate and also advice as to the extent to which he can act on the remaining operating time by using changes in the operating mode of the plant. For example, this may be helpful in the question as to whether the sealing element can then also remain installed until the next planned stoppage if production is carried out with a somewhat increased speed.

Furthermore, the invention comprises a device for monitoring a sealing structure for sealing at least one negative or positive pressure zone adjoining a surface moving in a direction of movement in a machine for producing or processing a fibrous web. The device comprises at least one sealing element having at least one wear sensor, preferably a plurality of wear sensors, a computer system and means for signal transmission from the at least one wear sensor to the computer system. The invention provides for a prediction of the remaining operating time of the sealing element to be carried out with the aid of the computer system by means of a method according to the invention.

In an advantageous embodiment of the device, the at least one sealing element can comprise or consist of a sealing strip.

According to an advantageous embodiment, the sealing element, in particular also the sealing strip, comprises at least one wear sensor which indicates a level of wear between 80% and 50% remaining wear and/or a wear sensor which indicates a level of wear between 20% and 10% remaining wear.

According to a further advantageous embodiment, the device comprises a display device which displays the remaining operating time of the sealing element. Provision can also be made for the device not to comprise a dedicated display device but to share a display device with other devices. Thus, the display device can be, for example, a monitor in a control room of the machine, on which still other values are displayed beside the remaining operating time or else alternating therewith.

In a preferred embodiment, provision can be made for the at least one wear sensor to comprise at least one hose which is filled with a medium and is destroyed with progressive wear of the sealing element. The pressure drop produced as a result can be determined and—depending on the installation position of the hose—can be used as an indication that a certain level of wear has been reached.

In a further preferred embodiment, provision can be made for the at least one wear sensor to comprise at least one optical fiber or an electrical conductor, which is destroyed with progressive wear of the sealing element.

Here, a change in the electrical resistance or an interruption to the current flow or a reduction or interruption in the conduction of light can be established and can serve as an indication that—depending on the installation position of the conductor—a certain level of wear has been reached.

In a further advantageous embodiment of the invention, provision can be made for the at least one wear sensor to comprise or consist of a temperature sensor. Such a temperature sensor can fulfill a dual function. Firstly, it supplies data about the temperature of the sealing element, that is to say, for example, the sealing strip, at the installation position of the temperature sensor. With progressive wear of the sealing element, the temperature sensor can then be damaged or destroyed. Thus, for example, the absence of a temperature measured signal from the temperature sensor can provide an indication that the wear of the sealing element has progressed as far as the installation position of the temperature sensor. Frequently, by means of such a temperature sensor, a rise in the temperature can be measured even before the destruction of the sensor by wear. In addition, information about the state of wear of the sealing element can be obtained from the knowledge of this temperature rise.

A further wear structure which can be monitored by means of a method according to the invention is a screen for treating a fibrous suspension. The screen baskets used there are wear elements which have to be replaced after some time. The accurate state of wear of the screen basket cannot be detected from outside. In particular, the most accurate prediction possible of the remaining operating time of the screen basket is very desirable.

A device which can be used for the use of the method according to the invention is described below in a further inventive idea.

This relates to a system for monitoring the state of a screen basket of a screen for treating a fibrous suspension.

The aim during screening is the separation of disruptive solid constituents from fibrous suspensions. Separation is carried out by screening in accordance with the particle features size, shape and deformability. Screening is an important separation method in the preparation of paper for recycling. Depending on the level of pulping and the loading of the suspension with foreign materials and fiber specks, different screens are used. Amongst others, so-called basket screens with a screen basket arranged in a housing are used.

In the previously known basket screens, the technical data of the screen basket is stamped onto an end ring of the screen basket. Since the screen basket is arranged in the housing of the relevant screen, reading this technical data is relatively complicated. In addition, the state of wear of the screen basket remains unknown, particularly also since no service life or history for the screen baskets is present and no operating data is available either.

The further inventive idea is based on the object of specifying a system for monitoring the state of a screen basket of a screen for treating a fibrous suspension in which the aforementioned problems are eliminated. The intention is in particular to ensure faster fault-free reading of the technical data relating to the screen basket and to permit more comprehensive monitoring of the state of the screen basket from outside.

The object of the further inventive idea is achieved by a system having the features of clause 1. Preferred embodiments of the system according to the invention can be gathered from the further clauses, the present description and the drawing.

According to the further inventive idea, the system for monitoring the state of a screen basket of a screen for treating a fibrous suspension comprises a cable-free identification unit assigned to the screen basket arranged in a housing of the screen and an external, in particular mobile, reading unit for the non-contact reading of technical data relating to the screen basket from the identification unit and for producing a connection to a further external database containing data relating to the screen.

On the basis of this configuration, the technical data relating to the screen basket can be read quickly and reliably in a cable-free and non-contacting manner from outside, i.e. from outside the housing of the screen. In addition, via the external reading unit, further data relating to the screen contained in an external database can be accessed, which means that more comprehensive monitoring of the state of the screen basket is made possible. Here, as the screen basket is installed, a corresponding item of screen basket information can be read into the external database. When the technical data relating to the screen basket is subsequently read from the identification unit assigned to the screen basket, the necessary allocation of data contained in the database to this screen basket can then be produced. The further data relating to the screen can, for example, be collected via a control system of the factory in which the screen is installed and supplied to the external database. Sales staff and customers can each be issued with an in particular mobile reading unit, so that these can monitor the screen basket from outside, i.e. from outside the housing.

A respective reading unit preferably comprises a display for reproducing further data relating to the screen and retrieved from the external database.

According to an expedient practical embodiment of the system, the identification unit comprises at least one RFID chip (RFID=radio-frequency identification).

Such an RFID chip in particular constitutes a transponder which contains the technical data relating to the screen basket. The transponder is a radio communication means which picks up and automatically answers incoming signals. The coupling can be made by alternating magnetic fields of low range, generated by the reading unit, or by high-frequency radio waves. It is therefore possible not only to transmit data but also to supply the transponder with energy. For greater ranges, an active RFID chip with its own power supply, for example, is also conceivable.

The reading device can contain software which controls the actual reading process for reading the technical data relating to the screen basket from the identification unit or the RFID chip. In addition, the reading unit can comprise RFID middleware with an interface to the external database.

The identification unit preferably comprises at least one RFID chip assigned to the screen basket of the screen.

According to an expedient practical embodiment of the system according to the further inventive idea, the identification unit comprises both an RFID chip assigned to the screen basket of the screen and also an RFID chip assigned to the housing of the screen, wherein the RFID chip assigned to the screen basket can be coupled via a software coupling to the RFID chip assigned to the housing, and the RFID chip assigned to the housing can be read via the reading unit.

Therefore, the reading unit can produce a connection between the RFID chip assigned to the housing and the external database. In this case, the connection between the RFID chip and the external database is not impaired by the generally metallic housing of the screen.

According to an alternative embodiment of the system, however, the RFID chip assigned to the screen basket of the screen can also be readable directly via the reading unit.

In particular in the case in which the RFID chip assigned to the screen basket of the screen can be read directly via the reading unit, the RFID chip assigned to the screen basket of the screen is preferably arranged in the region of the opening of the screen that can be closed via a cover. In order to read the relevant RFID chip, the cover of the screen can then be taken off, whereupon the RFID chip assigned to the screen basket of the screen can be read directly by means of the reading unit.

The RFID chip assigned to the screen basket of the screen can in particular be arranged on or in an end ring of the screen basket.

In particular for the aforementioned reasons, it is advantageous if the RFID chip assigned to the screen basket of the screen is arranged on or in an end ring of the screen basket that is adjacent to the opening of the screen that can be closed by a cover.

Here, the RFID chip assigned to the screen basket of the screen is preferably arranged on the upper side of the end ring, facing the opening of the screen.

It is also advantageous in particular if the RFID chip assigned to the screen basket of the screen is arranged on the radial inner side of the end ring, by which means the accessibility of the RFID chip for coupling to the reading unit is further improved.

Also conceivable, for example, is an embodiment in which the RFID chip assigned to the screen basket of the screen is accommodated so as to be countersunk in the end ring. The RFID chip accommodated so as to be countersunk in the end ring of the screen basket is preferably encapsulated here in plastic or preferably Teflon. Such a covering is expedient since the screen basket is generally reconditioned, i.e. in particular chromium-plated and electro-polished.

The aforementioned arrangement of the RFID chip assigned to the screen basket of the screen on or in an end ring of the screen basket takes account, amongst other things, of the fact that the end rings of a rod-type screen basket with rods extending between these end rings are subject to lower wear than the rods.

The further data relating to the screen is preferably stored together with the technical data relating to the screen basket in the external database. Via the technical data read from the identification unit assigned to the screen basket, the assignment to the further data relating to the screen can thus be made in the external database.

According to a preferred practical embodiment of the system according to the further inventive idea, the further data relating to the screen that can be retrieved from the external database via the reading unit comprises production data of the screen basket, service life data of the screen basket, operating data of the screen, wear data of the screen basket and/or the like.

Here, the production data of the screen basket can include, for example, the design, the material, the size and so on of the screen basket. The service life data of the screen basket can, for example, include data relating to the reconditioning of the screen basket, relating to storage times and so on. The operating data of the screen comprise, for example, the running time, the flow/pressure at the end ring/outlet of the screen, the rotational speed and so on. This information can be obtained, for example, via the machine control system of the screen.

It is also advantageous in particular if the system according to the invention comprises data-processing means in order, on the basis of the service life of previous screen baskets, the entire throughput previously treated by the screen basket, the rotational speed of the screen basket, the energy balance between the end ring and the outlets of the screen and/or the like, to determine the level of wear of the screen basket and therefore the next change date for the screen basket. In particular, provision can advantageously be made for a prediction of the remaining operating time of the screen basket to be determined by means of the method according to the invention on the basis of this data.

A system for monitoring the state of a screen basket of a screen according to the further inventive idea can be used in a plant for producing a fibrous web, either on its own or in combination with a device according to the invention for monitoring a sealing structure. Such a combination offers the advantage, amongst other things, that as a result the operator obtains more comprehensive knowledge relating to the current state of important wearing parts in his plant. Thus, for example, optimized stoppage planning can be carried out. A planned plant stoppage can then be scheduled, for example, such that sealing strips and screen baskets can be replaced jointly.

In the following text, essential features of the further inventive idea will be described once more in compact form by using numbered clauses referring back to one another. The designations placed in brackets refer to FIGS. 3 and 4.

The further inventive idea is subsequently also explained in more detail on the basis of an exemplary embodiment with reference to the drawings.

CLAUSES

Clause 1. A system (10) for monitoring the state of a screen basket (12) of a screen for treating a fibrous suspension, comprising a cable-free identification unit (14) assigned to the screen basket arranged in a housing of the screen, and an external, in particular mobile, reading unit (16) for the non-contact reading of technical data (18) relating to the screen basket (12) from the identification unit (14) and for producing a connection to a further external database (20) containing data relating to the screen.

Clause 2. The system as claimed in clause 1, characterized in that the reading unit (16) comprises a display for reproducing further data relating to the screen and retrieved from the external database.

Clause 3. The system as claimed in clause 1 or 2, characterized in that the identification unit (14) comprises at least one RFID chip.

Clause 4. The system as claimed in clause 3, characterized in that the identification unit (14) comprises at least one RFID chip assigned to the screen basket (12) of the screen.

Clause 5. The system as claimed in clause 4, characterized in that the identification unit (14) comprises both an RFID chip assigned to the screen basket (12) of the screen and also an RFID chip assigned to the housing (24) of the screen, wherein the RFID chip assigned to the screen basket (12) can be coupled via a software coupling to the RFID chip assigned to the housing (24), and the RFID chip assigned to the housing can be read via the reading unit (16).

Clause 6. The system as claimed in clause 4, characterized in that the RFID chip assigned to the screen basket (12) of the screen can be read directly via the reading unit (16).

Clause 7. The system as claimed in at least one of the preceding clauses, characterized in that the RFID chip assigned to the screen basket (12) of the screen is arranged in the region of the opening of the screen that can be closed via a cover.

Clause 8. The system as claimed in at least one of the preceding clauses, characterized in that the RFID chip assigned to the screen basket (12) of the screen is arranged on or in an end ring (22) of the screen basket (12).

Clause 9. The system as claimed in at least one of the preceding clauses, characterized in that the RFID chip assigned to the screen basket (12) of the screen is arranged on or in an end ring (22) of the screen basket (12) that is adjacent to the opening of the screen that can be closed by a cover.

Clause 10. The system as claimed in clause 9, characterized in that the RFID chip assigned to the screen basket (12) of the screen is arranged on the upper side of the end ring (22) that faces the opening of the screen.

Clause 11. The system as claimed in clause 9, characterized in that the RFID chip assigned to the screen basket (12) of the screen is arranged on the radial inner side of the end ring (22).

Clause 12. The system as claimed in clause 9, characterized in that the RFID chip assigned to the screen basket (12) of the screen is accommodated so as to be countersunk in the end ring (22).

Clause 13. The system as claimed in clause 12, characterized in that the RFID chip accommodated so as to be countersunk in the end ring of the screen basket (12) is provided with a covering or encapsulation in particular consisting of plastic and preferably of Teflon.

Clause 14. The system as claimed in at least one of the preceding clauses, characterized in that the further data relating to the screen is stored together with the technical data (18) characterizing the screen basket (12) in the external database (20).

Clause 15. The system as claimed in at least one of the preceding clauses, characterized in that the further data relating to the screen that can be retrieved from the external database (20) via the reading unit (16) comprises production data of the screen basket (12), service life data of the screen basket (12), operating data of the screen and/or the like.

Clause 16. The system as claimed in at least one of the preceding clauses, characterized in that it comprises data-processing means in order, on the basis of the service life of previous screen baskets, the entire throughput previously treated by the screen basket (12), the rotational speed of the screen basket (12), the energy balance between the end ring and the outlets of the screen and/or the like, to determine the level of wear of the screen basket (12) and therefore the next change date for the screen basket (12).

Although the method according to the invention can be used particularly advantageously in the cases outlined above, that is to say for monitoring a sealing structure and/or for monitoring a screen, it is not restricted to these applications.

The invention will be explained further below by using schematic figures, not to scale.

DESCRIPTION OF THE INVENTION

Figure 1:
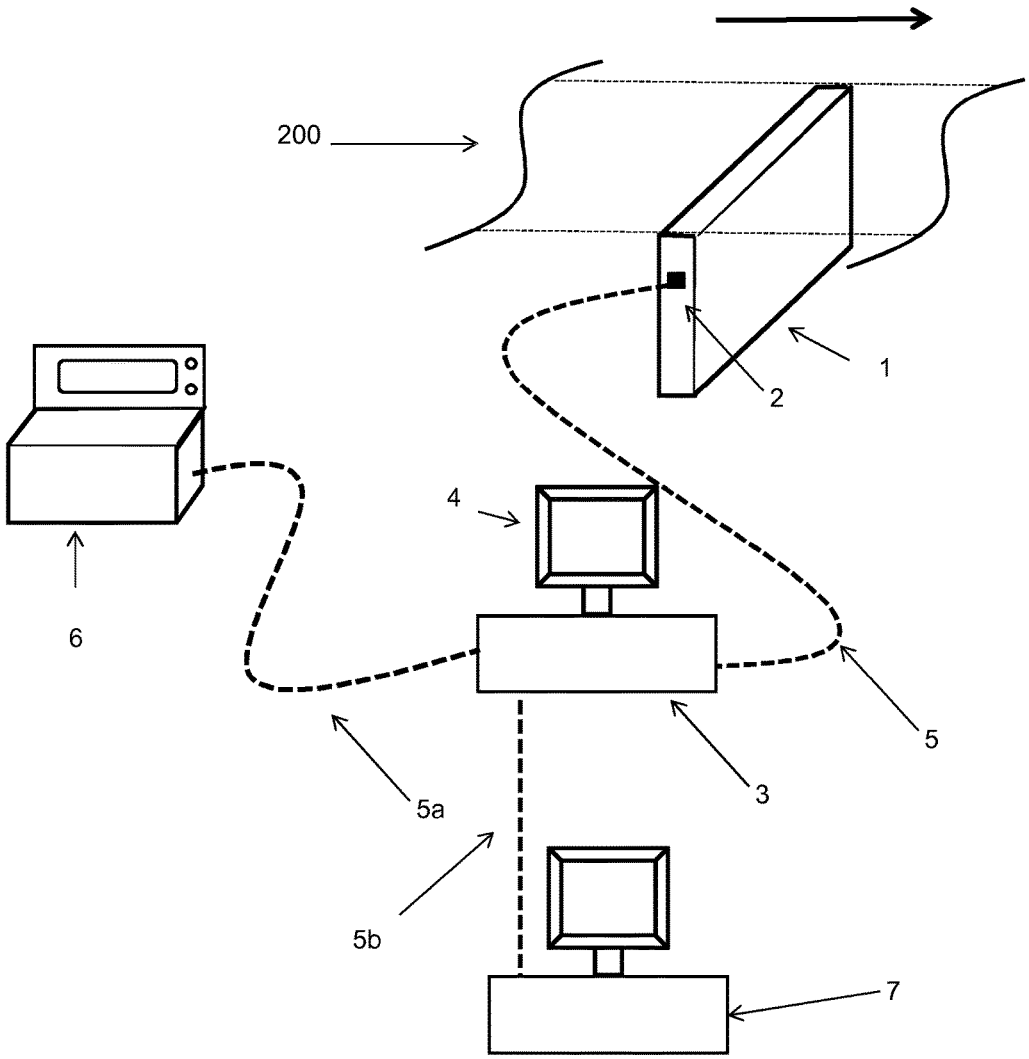
FIG. 1 shows, schematically, the essential components of the method according to the invention.

FIG. 1 shows, schematically, a sealing strip 1 which is in frictional contact with a moving surface 200. This sealing strip 1 can be used in a suction roll to seal off a suction or blowing zone with respect to the surroundings. However, it can also be in contact with a fabric, in particular a wire or a press felt, in order for example to seal off a suction box. The sealing strip 1 in FIG. 1 comprises a wear sensor 2. This sensor 2 generates a signal as soon as a defined level of wear of the sealing strip 1 is reached. FIG. 1 shows a sealing strip 1 comprising a sensor 2, but sealing strips 1 frequently comprise multiple wear sensors, preferably two or three. As a result, it is possible to define multiple levels of wear at which, when they are reached, the sealing strip 1 transmits a signal. Advantageously, one of the levels of wear can be defined between 80% and 50% remaining wear. The exact knowledge of reaching a comparatively early level of wear makes it possible to determine a first prediction of the remaining operating time of the sealing element 1 very early.

Likewise, it may be advantageous if one of the levels of wear is defined between 20% and 10% remaining wear, preferably between 20% and 15% remaining wear. The exact knowledge of reaching a comparatively late level of wear permits a more accurate prediction of the remaining operating time of the sealing element 1. However, the sensors 2 can also be positioned such that they provide a signal at levels of wear other than those specified above, in particular also between 50% and 20% remaining wear. However, it is important for the method to know at what level of wear the respective sensor 2 transmits a signal. This is defined before the installation and the sensors are positioned appropriately.

The sensor signal is transmitted to a computer system via a signal line 5. The transmission can be carried out in a cable-bound or cable-free manner, for example via WLAN, Bluetooth or similar suitable signal lines 5. In the example shown in FIG. 1, one or more further characteristic variables are additionally transferred to the computer system 3. These characteristic variables are transmitted here by the control system 6 of the machine and can describe operating states of the machine, such as, for example, machine speeds, operating times of the machine, the stoppage times of the machine, the type and/or quantity of the products produced, or the contact pressure of the sealing element onto the moving surface. These characteristic variables can be transmitted to the computer system 3 continuously or at specific discrete times.

On the basis of the time z0 at which the sealing strip 1 was installed and the time z1 at which a specific level of wear was reached, together with the further characteristic variables from the control system 6, the computer system 3 calculates a prediction for the remaining operating time of the sealing strip 1. The time z1 is transmitted here by means of a signal from the sensor 2 in the sealing strip 1. If more than one sensor 2 is installed, if appropriate signals are transmitted to the computer system 3 at further times z2, z3, z4 . . . , by which means the prediction can be improved by renewed calculation.

The sensors usually supply a signal to the computer system 3 only at the discrete times z1, z2, z3, z4 . . . . At the times in between, the computer system updates the remaining running time continuously by using the characteristic variables from the control system and the current time.

The computer system 3 usually has a display device 4, on which the remaining operating time can be displayed.

FIG. 1 shows the computer system 3 and the control system 6 as physically separated objects which are connected to each other by means of a cable-bound or cable-less signal line 5*a*. However, it is also possible for the two computer systems to be implemented in one unit. In this case, the calculation of the prediction of the remaining operating time can be carried out on a computing unit of the control system 6. The remaining operating time can then be displayed, for example, on one or more monitors in a control room of the machine.

In the system shown in FIG. 1, the computer system 3 is additionally connected to a further computer system 7 via a signal line 5*b*. This can be an electronic procurement system 7. Once the remaining operating time of the sealing strip 1 reaches a previously defined threshold value, a signal can then be transmitted to the procurement system 7 in order to trigger a timely purchase of a new sealing strip 1 or the like. Alternatively or additionally, when another or the same threshold value is reached, a signal can also be transmitted to a further computer system 7 which plans or administers the planning of maintenance work on the machine.

Figure 2:
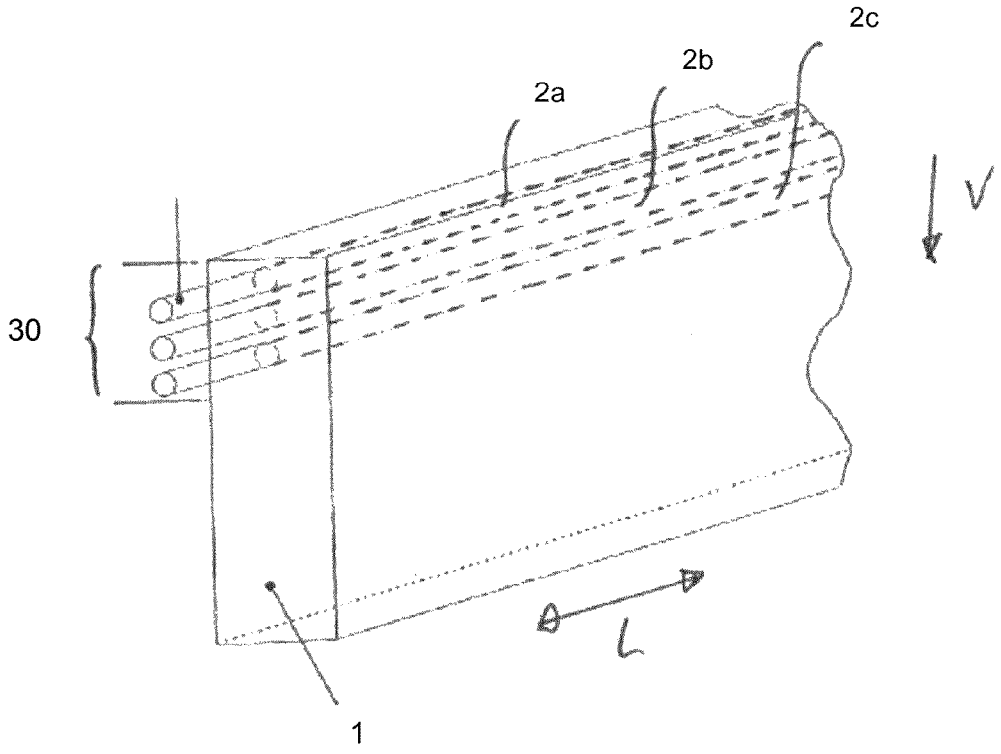
FIG. 2 shows, schematically, a detail from a sealing strip in a device according to the invention.

FIG. 2 shows a detail of a sealing strip 1 for a device according to the invention. The sealing strip 1 has a certain maximum wear volume 30 in the direction of wear V. Once this volume 30 has been removed by the frictional contact of the sealing strip 1 with the moving surface 200 or by other effects, the sealing strip 1 can no longer fulfill its function and it is even possible for damage to occur to the moving surface 200, for example the suction roll shell or the fabric. The remaining operating time of the sealing strip 1 is therefore the time interval until the maximum wear volume has been removed completely over the length L of the sealing strip 1, at least at one location. In the sealing strip shown in FIG. 2, three wear sensors 2*a*, 2*b*, 2*c* are provided. They can each be implemented as a hose which is filled with a medium, for example air or water. However, other types of wear sensors 2*a*, 2*b*, 2*c* are also imaginable, such as, for example, optical sensors (optical fibers) or electrical conductors. The first sensor 2*a* can be positioned, for example, such that it outputs a signal as soon as only a level of wear between 80% and 50% of the maximum wear volume 30 is still available. The third sensor 2*c* can be positioned, for example, such that it outputs a signal as soon as only a level of wear between 20% and 10% of the maximum wear volume 30 is still available. The second sensor 2*b* can be positioned between the two others and, for example, output a signal as soon as only a level of wear between 40% and 30% of the maximum wear volume 30 is still available. These values are to be understood as exemplary and can also be considerably different, depending on situation and installation position.

It is advantageous that the last sensor 2*c* is positioned such that, at the time of the sensor signal or reaching the appropriate level of wear, sufficient operating time of the sealing element 1 still remains that sufficient time is left for planned and controlled maintenance or replacement of the sealing element—preferably within the context of a routine stoppage of the machine.

Figure 3:
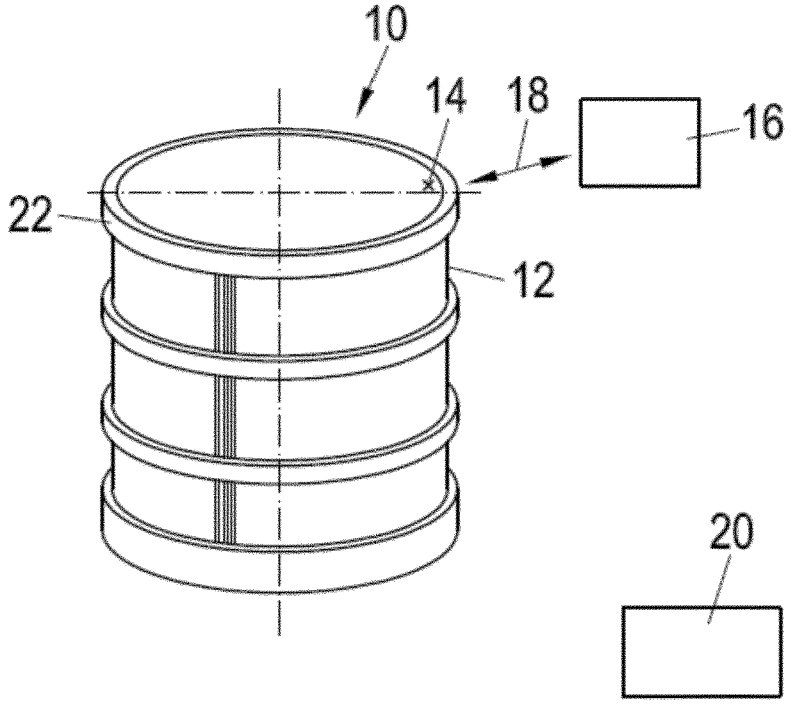
FIGS. 3 and 4 show, in a purely schematic illustration, an exemplary embodiment of a system for monitoring the state of a screen basket according to the further inventive idea.

In the drawing, FIG. 3 shows, in a purely schematic illustration, an exemplary embodiment of a system 10 for monitoring the state of a screen basket 12 of a screen for treating a fibrous suspension according to the further inventive idea.

Figure 4:
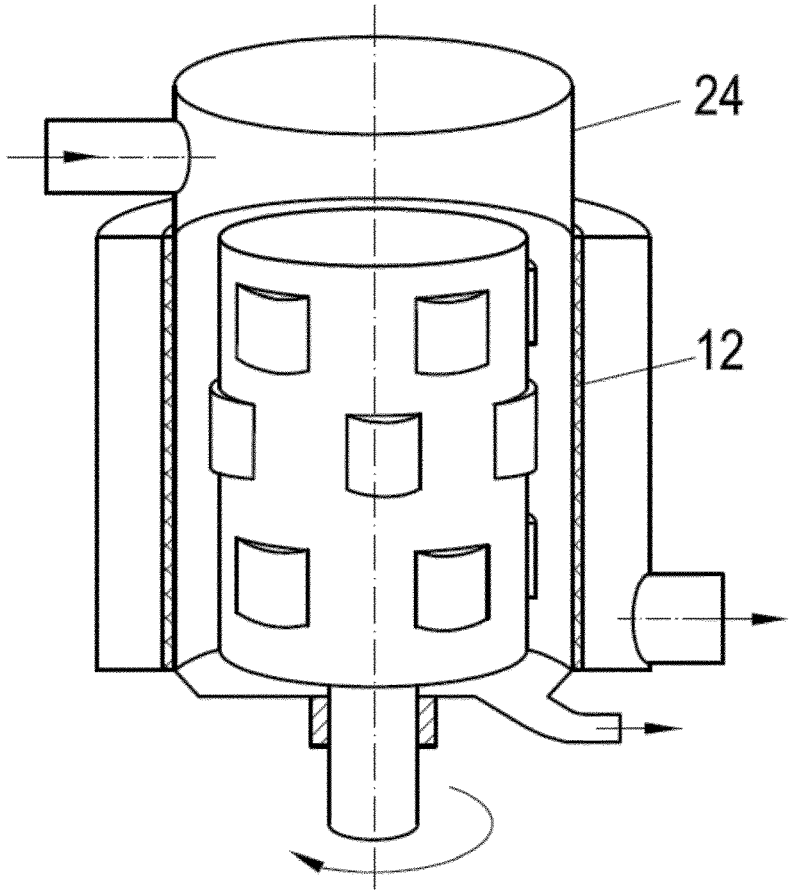

According to FIG. 4, the system 10 comprises a cable-free identification unit 14 assigned to the screen basket 12 arranged in a housing 24 of the screen, and an external, in particular mobile, reading unit 16 for the non-contact reading of technical data 18 relating to the screen basket 12 from the identification unit 14 and for producing a connection to an external database 20 containing further data relating to the screen.

The reading unit 16 can comprise a display for reproducing further data relating to the screen and retrieved from the external database.

The identification unit 14 can comprise at least one RFID chip. In this case, it comprises at least one RFID chip assigned to the screen basket 12 of the screen.

According to an exemplary embodiment of the system according to the further inventive idea, the identification unit 14 can comprise both an RFID chip assigned to the screen basket 12 of the screen and an RFID chip assigned to the housing 24 of the screen, wherein the RFID chip assigned to the screen basket 12 can be coupled via software coupling to the RFID chip assigned to the housing 24, and the RFID chip assigned to the housing 24 can be read via the reading unit 16.

According to an alternative exemplary embodiment of the system 10, the RFID chip assigned to the screen basket 12 of the screen can also be readable directly via the reading unit 16.

In particular in the case in which the RFID chip assigned to the screen basket 12 of the screen is readable directly via the reading unit 16, the RFID chip assigned to the screen basket 12 of the screen is expediently arranged in the region of the opening of the screen that can be closed via a cover.

The RFID chip assigned to the screen basket 12 of the screen can in particular be arranged on or in an end ring 22 of the screen basket 12 that is adjacent to the opening of the screen that can be closed by a cover. In the present case, the RFID chip assigned to the screen basket 12 of the screen is accordingly arranged on or in the upper end ring 22 of the screen basket 12.

The RFID chip assigned to the screen basket 12 of the screen can be arranged, for example, on the upper side of the end ring 22, facing the opening of the screen, or else on the radial inner side of the end ring 22.

However, also conceivable, for example, is an embodiment in which the RFID chip assigned to the screen basket 12 of the screen is accommodated so as to be countersunk in the end ring 22. The RFID chip accommodated so as to be countersunk in the end ring 22 of the screen basket 12 can be provided with a covering consisting in particular of plastic and preferably of Teflon. By using such a covering, account is taken of the fact that the screen basket 12 is generally reconditioned, i.e. chromium-plated and electropolished.

The further data relating to the screen can be stored together with the technical data relating to the screen basket 12 in the external database 20. Via the technical data 18 read from the identification unit 14 of a respective screen basket 12, the relevant further data contained in the external database 20 can thus be assigned to the screen basket 12.

The further data relating to the screen that can be retrieved from the external database 20 via the reading unit 16 can in particular comprise production data of the screen basket 12, service life data of the screen basket 12, operating data of the screen and/or the like. The production data of the screen basket 12 comprises, for example, data relating to the design, the material, the size or the like of the screen basket 12. The service life data of the screen basket 12 can comprise, for example, data relating to the reconditioning of the screen basket 12, storage times and so on. The operating data of the screen comprises, for example, data relating to the running time, the flow/pressure at the end ring/outlet of the screen, data relating to the rotational speed of the screen basket 12 and/or the like. The relevant information can in particular be supplied by the machine control system of the screen.

Such a system can also be monitored by means of the method according to the invention. As a result, a prediction of the remaining operating time of the wear element 12, that is to say of the screen basket 12, is supplied. This information can be used, for example, for optimizing the stoppage planning.

In addition, the system 10 according to the further inventive idea, for example, can comprise data-processing means integrated in the reading device 16 and/or in the external database 20, in order, on the basis of the service life of previous screen baskets, the entire throughput previously treated by the screen basket 12, the rotational speed of the screen basket 12, the energy balance between the end ring and the outlets of the screen and/or the like, to determine the level of wear of the screen basket 12 and therefore the next change date for the screen basket 12.

The invention claimed is:

1. A sealing assembly, comprising:

a device for monitoring a sealing structure including at least one sealing element for sealing at least one negative or positive pressure zone adjoining a surface moving in a direction of movement in a machine for producing or processing a fibrous web;

at least one wear sensor associated with said at least one sealing element;

a signal transmission device for transmitting a signal from said at least one wear sensor; and a computer system receiving the signal from said signal transmission device, said computer system being configured to carry out the following steps:

providing a time z0 at which the sealing element became operational;

providing a time z1 at which a defined first level of wear of the sealing element was reached;

providing at least one further characteristic variable describing a machine speed, operating times of the machine, stoppage times of the machine, at least one of type or quantity of products being produced, or a contact pressure of the sealing element onto the moving surface; and predicting a remaining operating time of the sealing element from the times z0 and z1 and the at least one further characteristic variable.

2. The sealing assembly according to claim 1, wherein the computer system predicts the remaining operating time of the sealing element from a time difference between z0 and z1 and the at least one further characteristic variable.

3. The sealing assembly according to claim 1, wherein said at least one wear sensor includes a plurality of wear sensors.

4. The sealing assembly according to claim 1, wherein said at least one wear sensor includes at least one of a wear sensor indicating a level of wear of between 80% and 50% of a remaining wear or a wear sensor indicating a level of wear of between 20% and 10% of the remaining wear.

5. The sealing assembly according to claim 1, wherein said at least one wear sensor includes at least one optical fiber, an electrical conductor, a temperature sensor or a hose being filled with a medium, and said optical fiber, electrical conductor, temperature sensor or hose is destroyed with progressive wear of said sealing element.

6. The sealing assembly according to claim 1, wherein said computer system is configured to carry out the following steps:

providing additional further characteristic variables in addition to the characteristic variable; and incorporating the further characteristic variables into the step of predicting the remaining operating time.

7. The sealing assembly according to claim 6, wherein said computer system is configured to carry out the following step:

using at least one of the further characteristic variable K1 or one or more of the additional further characteristic variables to describe one or more aspects of an operating mode of the machine.

* * * * *